United States Patent [19]

Bell, Jr. et al.

[11] 4,374,501

[45] Feb. 22, 1983

[54] GARMENT TOE CLOSING ASSEMBLY

[75] Inventors: Cecil R. Bell, Jr.; George D. Nakhle, both of Pinnacle; A. Russell Edwards, Winston-Salem, all of N.C.

[73] Assignee: Consolidated Foods Corporation, Winston-Salem, N.C.

[21] Appl. No.: 170,022

[22] Filed: Jul. 18, 1980

[51] Int. Cl.[3] ..... D05B 21/00

[52] U.S. Cl. ..... 112/121.15; 112/260

[58] Field of Search ..... 112/121.15, 121.11, 112/121.12, 2, 260; 223/43, 112

[56] References Cited

U.S. PATENT DOCUMENTS

| | | | |
|---|---|---|---|
| 3,859,938 | 1/1975 | Fukuyama | 112/121.15 |
| 3,875,880 | 4/1975 | Hazelgrove | 112/121.15 |
| 3,941,069 | 3/1976 | Fukuyama | 112/121.15 |
| 4,120,251 | 10/1978 | Takatori et al. | 112/121.15 |
| 4,133,277 | 1/1979 | Arthur et al. | 112/121.15 |
| 4,133,280 | 1/1979 | Takatori et al. | 112/121.15 |

FOREIGN PATENT DOCUMENTS

| | | | |
|---|---|---|---|
| 2275164 | 1/1976 | France | 112/121.15 |

*Primary Examiner*—H. Hampton Hunter

*Attorney, Agent, or Firm*—Charles Y. Lackey; William S. Burden

[57] ABSTRACT

An improved assembly for facilitating the closing of an end portion of a tubular hosiery blank positioned upon a support assembly includes a tubular unit having a metallic hollow core provided with a molded urethane coating covering the outer portion of the core, and having diametrically opposed urethane fins defining guide slots for supporting and freely slidably receiving therein reciprocable blades. The radially extending urethane fins are tapered outwardly and extend substantially the full length of the core member.

8 Claims, 5 Drawing Figures

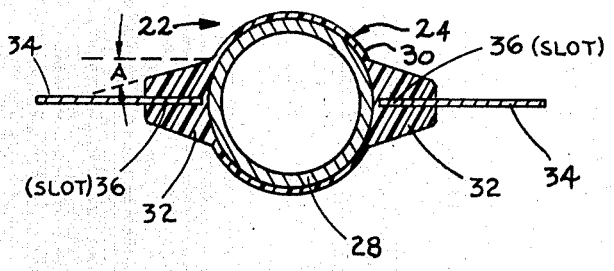
FIG. 5
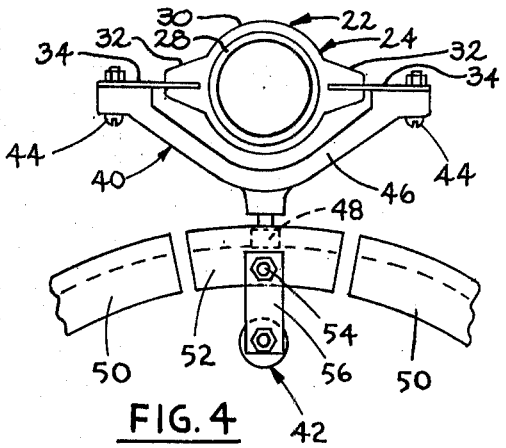
FIG. 4
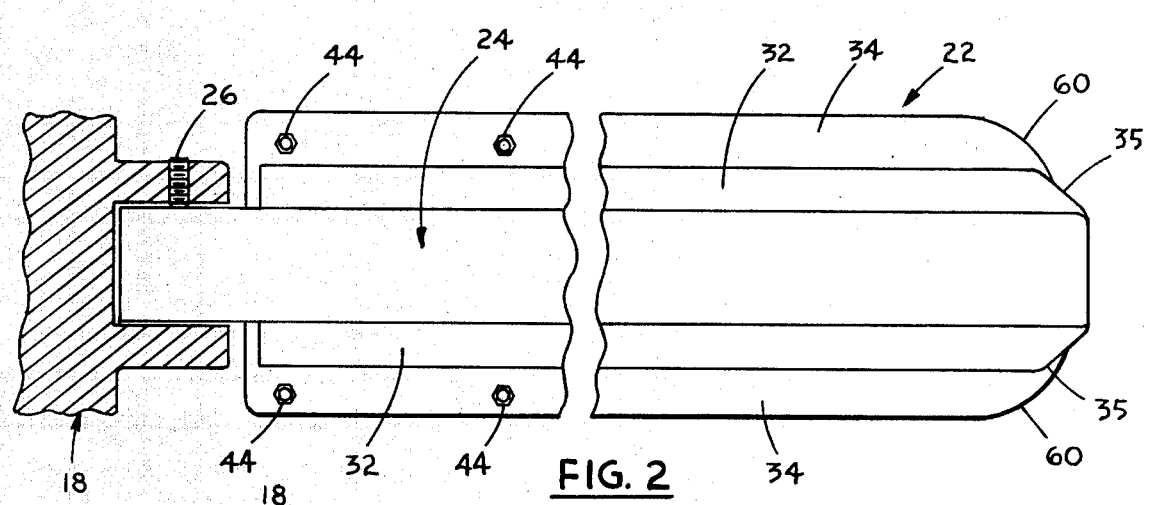
FIG. 2
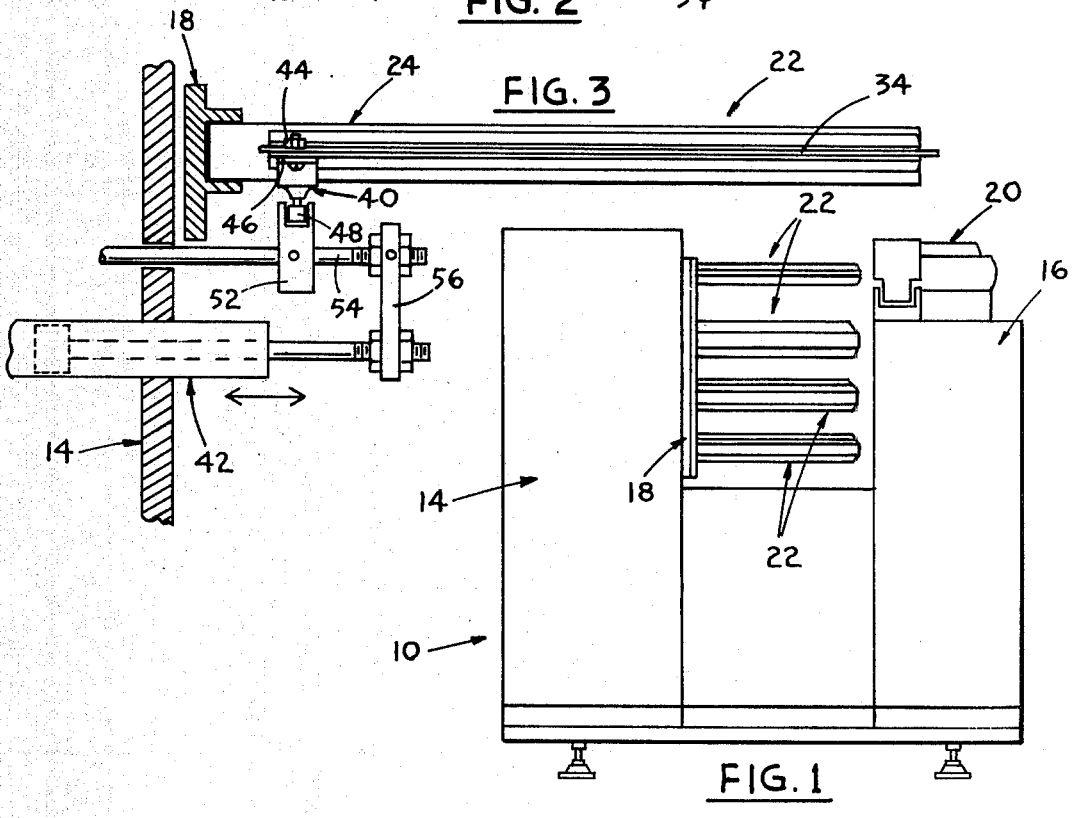
FIG. 3
FIG. 1

GARMENT TOE CLOSING ASSEMBLY

BACKGROUND, BRIEF SUMMARY AND OBJECTS OF THE INVENTION

This invention is directed to improvements relating to apparatus for use in facilitating the toe closing operation on a series of seamless hosiery blanks sequentially.

Several automatic mechanisms for closing end portions of seamless tubular blanks are known, as shown for example by U.S. Pat. Nos. 3,875,880; 3,941,069; 3,859,938 and 3,420,196. In a number of prior art mechanisms, a plurality of hosiery blank support units are attached to a turret or spider assembly for displacement of each support unit to a plurality of work stations. The support units may be controlled in a manner for continuous displacement at a selected speed or in intermittent steps having a selected time interval between successive steps. Each support unit may include an elongated tube supported adjacent one end and adapted to be selectively coupled to a suction means. In one well known method of operation, the hosiery blank is drawn into a tube by suction, toe end first, while an operator holds the welt end of the blank. The operator then draws the blank outwardly onto the support tube thus everting the blank. The hosiery blank toe portion may then be selectively positioned manually or automatically relative to the tube end and a pair of finger blades are displaced relative to the support tube for presenting the toe portion to clamping and sewing instrumentalities. The blades are retracted prior to sewing of the toe portion. After the sewing operation, the toe closed hosiery blanks may be automatically removed from the apparatus in a conventional manner.

In a number of the known systems opposed guide plates or fins are secured to diametrically opposite portions of each tube and define guide slots for slidably receiving the fingers for displacement longitudinally of the tubes. Normally the tubes are of metal construction having a black oxidized finish. Wear occurs between the blades and the fins due to continued reciprocation and binding of the blades within the grooves defined by the fins, and a fine, black dust is generated. As the finished hosiery blanks are placed upon or removed from the tubes and blades, they pick up the black dust and dirt. As a result, the hoisery blanks must be washed subsequent to the toe closing operation and prior to packaging of the goods.

Briefly described, the present invention relates to a new improved system for use in closing the toe portion of a hosiery blank. The support tube consists of a plastic or resinous material molded around an aluminum core member and defining fins for slidably receiving therein a pair of displaceable blades. The tube is supported upon a turret member and, when properly positioned, the blades are displaced longitudinally of the tube by an actuator.

One of the primary objects of the invention is the provision of a new and improved system for closing the toe of a hosiery blank.

Another object of the invention is the provision of a novel hosiery blank support unit.

A further object of the invention is the provision of a new and improved apparatus for projecting an end portion of a hosiery blank to a clamping and sewing assembly.

Still another object of the invention is the provision of a novel support tube and a reciprocable blade assembly which eliminates excessive wear and the soiling of the hosiery blanks.

BRIEF DESCRIPTION OF THE DRAWING

FIG. 1 in a schematic side elevational view of a toe closing machine;

FIG. 2 is a schematic top plan view of a hosiery blank support unit illustrating the tube, fins, and blades;

FIG. 3 is a side elevational view of the support unit of FIG. 2, on a reduced scale, and illustrating the blades slightly projected beyond the end portion of the support tube;

FIG. 4 is a fragmentary, enlarged view of the assembly taken from the right side of FIG. 3; and FIG. 5 is a sectional view through the support tube.

DETAILED DESCRIPTION OF THE INVENTION

Referring to the drawing, and initially to FIG. 1, reference numeral 10 designates a conventional toe closing apparatus including a machine frame having spaced support assemblies 14 and 16, a turret assembly 18 mounted upon assembly 14, and a sewing and clamping assembly 20 mounted upon support assembly 16. The machine may be of the Speedomatic HS type manufactured by Detexomat Machinery, Limited.

The turret assembly 18, including the series of hosiery blank support assemblies 22 equally spaced in a circular configuration, may be indexed in a conventional manner to sequentially position the assemblies 22 at a plurality of work stations.

Each support assembly 22 includes an elongated tubular unit 24 fixedly secured to the turret 18 by a conventional fastener 26. Each unit 24 consists of a hollow core member 28 preferably of aluminum construction having the outer surfaces encompassed with a resinous coating 30. The aluminum member 28 is sealed in a mold and the resin is molded around the member. Provisions for fins are incorporated in the mold, and the resultant tubular unit 24 includes the member 28, having resinous diametically opposed, radially extending fins 32 secured thereto which extend substantially the entire length of the member 28. A resinous coating having a thickness of approximately five hundredths of an inch covers the member 28 between the fins 32. Each fin 32 is provided with a radially extending guide slot 36 extending the length of the fin for slidably receiving a blade 34. The outer end portions 35 of the fins may be rounded or tapered, as shown by FIG. 2 to facilitate positioning of a blank thereon. In a preferred embodiment, the resinous coating consist of urethane having a durometer hardness of 90. The fins project outwardly a selected distance, and in one embodiment may be generally equal to one half of the width of a blade 34. The upper and lower portions of each fin, FIG. 5, are tapered at approximately an angle A of 15°, and the outer portions adjacent the slots 36 are rounded to assist in placing the blanks upon the tubular unit and removal therefrom.

The depth of the slots 36 may be within the range of one third to one half of the width of the blades 34 for adequately supporting and guiding the blades as they are reciprocated longitudinally of the tubular unit 24. The hardness of the urethane and the width of the slots 36 are such to snugly receive and support the blades while at the same time permitting the blades to be easily displaced relative to the fins and eliminate undesirable wear of the components.

Referring to FIGS. 2–4, the blades 34,34 of a support assembly 22 are mounted upon a saddle assembly 40 which, in turn, is selectively reciprocated by an actuator 42. Conventional fasteners 44 extend through openings adjacent one end of the blades 34 to secure the blades to a generally U-shaped bracket 46. Depending from the bracket 46 is a roller 48 which normally is received within and displaceable along a fixed track section 50 or received within a reciprocable track section 52. The reciprocable section 52 is attached to a rod 54 which is slidably supported by the support assembly 14 and selectively reciprocated by the actuator 42 through a bracket 56. In a preferred embodiment the actuator 42 consists of a conventional fluid cylinder which is secured to assembly 14.

The blades or fingers 34,34 of each assembly 22 are of flat, thin metal construction having rounded outer end protions 60. As shown most clearly by FIG. 2, and in the retracted position, the outermost end portions 60,60 are received within the slots 36 of fins 32 in order to facilitate the pulling of a hosiery blank over the end of the assembly 22.

In the operation of the apparatus, hosiery blanks are sequentially pulled onto the tubular units 24 as they are indexed by the turret 18 past a work station. The outer end of a blank is selectively positioned adjacent the outer ends of the tubular unit 24 and blades 60. Upon rotation of the turret 18 and support assemblies 22, the track section 50 serves to retain the blades 34 in a retracted position. As an assembly 22 is indexed to the clamping and sewing station, the guide roller 48 moves from track section 50 onto section 52. The fluid cylinder 42 is actuated and section 52 urges the roller 48, bracket 46 and blades 60,60 to the right, FIG. 3, and the blades slide within the fins 32 and the end portions 60,60 are projected a prescribed distance beyond the end of the tubular unit 24. As the blades extend beyond the end of unit 24, they carry the hosiery blank end portion to the clamping and sewing assembly 20. The assembly 20 may be of the type disclosed by French Pat. No. 2,275,164 of Detexomat Machinery Limited. Upon clamping of the hosiery blank end portion, the blades 34 are retracted by actuator 42 and the blank end portion is closed by a sewing machine. After the sewing operation has been completed, the turret indexes the hosiery blank to a station where it is removed from the support assembly 22.

What is claimed is:

1. In an apparatus having clamping and sewing instrumentalities for closing an end portion of a tubular hosiery blank, and an indexable turret assembly including a plurality of displaceable blank support assemblies for sequentially positioning the support assemblies at a series of work stations, each said support assembly including an elongated tubular unit secured to the turret assembly, blade means, and actuator means for selectively displacing said blade means, said tubular unit including core means and means encompassing said core means, said encompassing means including opposed fins, said fins defining slots therein for slidably supporting and guiding said blade means.

2. In an apparatus as recited in claim 1, said encompassing means comprising a resinous coating molded upon said core means with said opposed fins extending radially outwardly from said core means.

3. In an apparatus as recited in claim 2, said resinous coating comprising urethane having a durometer hardness of approximately 90.

4. In an apparatus as recited in claim 2, said fins defining said slots extending substantially the entire length of said core means and having arcuate outer edges, said blade means including spaced, paralled blades, each having a length generally corresponding to the length of said fins.

5. In an apparatus as recited in claim 2, said blade means including a pair of parallel, flat, relatively thin blades slidably received within said slots, said blade means further including bracket means having said blades secured thereto and a bearing secured to said bracket means, said actuator means comprising a fluid cylinder means coupled to said bearing for selective reciprocating said blade means relative to said fins.

6. In an apparatus as recited in claim 5, each of said fins having a substantial portion of a blade received within a slot, each of said fins tapering towards the blade portions extending outwardly of said fin slots.

7. In an assembly for supporting or tubular hosiery blank including an elongated tubular unit for supporting and guiding of plurality of blades as the blades are selectively reciprocated to present a blank end portion to a prescribed location for subsequent sewing of the blank end portion, said tubular unit including an elongated, hollow cylindrical portion having diametrically opposed fins integral therewith, each of said fins defining a radial slot extending longitudinally of said cylindrical portion for slidably receiving a blade therein, said cylindrical portion and said fins being of molded, resin construction, each fin being tapered and reduced in thickness as it extends radially from said cylindrical portion.

8. In an assembly as recited in claim 7, said resin comprising uretbane having a durometer hardness of approximately 90.

* * * * *